US011466433B2

(12) United States Patent
Ladhe

(10) Patent No.: US 11,466,433 B2
(45) Date of Patent: Oct. 11, 2022

(54) MECHANISM FOR RAISING AND LOWERING LIFTING ARMS OF A WORK VEHICLE

(71) Applicant: Mahindra and Mahindra Limited, Tamil Nadu (IN)

(72) Inventor: Digambar Ladhe, Maharashtra (IN)

(73) Assignee: MAHINDRA AND MAHINDRA LIMITED, Tamil Nadu (IN)

( * ) Notice: Subject to any disclaimer, the term of this patent is extended or adjusted under 35 U.S.C. 154(b) by 0 days.

(21) Appl. No.: 17/196,291

(22) Filed: Mar. 9, 2021

(65) Prior Publication Data

US 2022/0136212 A1 May 5, 2022

(30) Foreign Application Priority Data

Nov. 3, 2020 (IN) ..... 202041010430

(51) Int. Cl.
*E02F 9/22* (2006.01)
*E02F 9/20* (2006.01)
*F15B 13/04* (2006.01)

(52) U.S. Cl.
CPC ..... *E02F 9/2203* (2013.01); *E02F 9/2004* (2013.01); *E02F 9/2228* (2013.01); *E02F 9/2271* (2013.01); *E02F 9/2289* (2013.01); *F15B 13/0402* (2013.01)

(58) Field of Classification Search
CPC ..... E02F 9/2004; F15B 13/0402; B62D 5/07; B62D 5/06
See application file for complete search history.

(56) References Cited

U.S. PATENT DOCUMENTS 2,363,179 A * 11/1944 Harrington ..... B62D 5/09 91/516
6,502,661 B1 * 1/2003 Heitzer ..... B62D 3/14 180/403
6,612,393 B2 * 9/2003 Bohner ..... B62D 5/003 180/402
8,636,098 B2 * 1/2014 Fu ..... B62D 5/087 180/441

* cited by examiner

*Primary Examiner* — Abiy Teka
(74) *Attorney, Agent, or Firm* — Lathrop GPM LLP; Douglas Link

(57) ABSTRACT

A mechanism (100) for raising and lowering lifting arms (104) of a work vehicle includes an operating lever (111) that is secured at the column (103) of the steering wheel (102) of the work vehicle, a hydraulic arrangement and at least one linkage for operating the lifting arms (104). The hydraulic arrangement further includes a plurality of piston-cylinder pairs (105*a*-105*b*, 110*a*-110*b*, 115*a*-115*b*, 120*a*-120*b*, and 125*a*-125*b*) provided between the operating lever (111) and the linkage, for controlling the raising and lowering operation of the lifting arms (104). The operating lever (111) permits an effective and easy control of the raising and lowering operation of the lifting arms (104).

4 Claims, 10 Drawing Sheets

MECHANISM FOR RAISING AND LOWERING LIFTING ARMS OF A WORK VEHICLE

CROSS REFERENCE TO RELATED APPLICATIONS

This application claims priority to Indian application number 202041010430, filed on Nov. 3, 2020, the disclosure of which is incorporated by reference herein in its entirety.

FIELD

The present disclosure relates to the field of hydraulics in work vehicle for position control and draft control.

Definitions

As used in the present disclosure, the following terms are generally intended to have the meaning as set forth below, except to the extent that the context in which they are used indicate otherwise.

Position control:—The term "position control" hereinafter refers to the control of the height of the three-point hitch.

Draft control:—In draft control the main lever actually selects the tractive force of a tillage implements.

BACKGROUND

The background information herein below relates to the present disclosure but is not necessarily prior art.

At present, position control and draft control operation of a hydraulic system in work vehicles such as tractors is done by levers fitted besides the driver's seat. Thus, there are two separate levers for this purpose. These levers are connected with a hydraulic unit. These levers operate the hydraulic system with the help of mechanical linkages. For example, in some tractor models available in the market, the mechanical linkages are used for operating a spool of a control valve for position control and the same linkages are available for draft control.

However, the conventional hydraulic system comprises a number of mechanical components which increases the costs and the complexity of the hydraulic system. Further for fitment of these components manpower and separate facilities are required, which further increases the manufacturing cost of the final product. The levers are positioned besides the seat of the driver. The driver has to first locate the exact position of each lever before operating the same. The conventional positioning of these levers is often ergonomically incorrect and adds to the stress of the driver.

Further, in the existing tractors the position control and draft control happens with the help of the linkage mechanism fitted adjacent to seat of the user/driver of the tractor. This linkage mechanism consumes space in the tractor and in the case of compact tractors, where space requirement is critical, the use of these linkages hinders ease of operation during position and draft control. Further, a user needs to shift the focus away from the steering wheel during position and draft control operation in order to operate the linkages leading to safety issues. The presence of linkages thus leads to reduction in working space of the user/driver of the tractor. Thus, these mechanical linkages hinder the overall space availability for the user during the working of the tractor.

There is, therefore, felt a need of a compact mechanism for raising and lowering lifting arms of a work vehicle which alleviates the aforementioned issues.

Objects

Some of the objects of the present disclosure, which at least one embodiment herein satisfies, are as follows:

An object of the present disclosure is to provide a mechanism for raising and lowering of lifting arms of a work vehicle.

Another object of the present disclosure is to provide a mechanism for raising and lowering of lifting arms of a work vehicle that is compact and easy to operate.

Yet another object of the present disclosure is to provide a mechanism for raising and lowering of lifting arms of a work vehicle that eliminates the levers provided on the side of the driver's seat.

Another object of the present disclosure is to provide a mechanism for operating a hydraulic system for a tractor that is simple in design.

Other objects and advantages of the present disclosure will be more apparent from the following description, which is not intended to limit the scope of the present disclosure.

SUMMARY

The present disclosure envisages a mechanism for raising and lowering lifting arms of a work vehicle. The mechanism includes an operating lever secured at the column of the steering wheel of the vehicle, a hydraulic arrangement and at least one linkage provided between the operating lever and the lifting arms of the work vehicle. The hydraulic arrangement further comprises a plurality of piston-cylinder pairs that is provided between the linkage and the operating lever for controlling the raising and lowering operation of the lifting arms in accordance with the movement of the operating lever.

In an embodiment, the mechanism includes a plurality of linkages provided between the operating lever and the lifting arm of the work vehicle.

In an embodiment, the piston-cylinder pairs are defined by a main piston reciprocating inside a main cylinder wherein the main piston is configured to provide a motive force for raising and lowering of the lifting arms via a drive-link, a main control valve with a spool provided thereon configured for controlling the flow of pressurized fluid into and out of the main cylinder, a first piston reciprocating inside a first cylinder wherein the first piston is in contact with the spool and configured to actuate the spool, a second piston reciprocating inside a second cylinder wherein the second piston is mechanically connected to the lifting arms and is configured to move in accordance with the movement of the lifting arms, a third piston reciprocating inside a third cylinder wherein the third piston is connected to a farming/tilling equipment and a fourth piston reciprocating inside a fourth cylinder. The fourth piston is located on the column of the steering wheel of the work vehicle and is coupled to the operating lever.

In an operative configuration, all the cylinders are connected to each other via fluid conduits while the operating lever is mechanically coupled to the fourth piston. The operating lever is configured to control the raising and lowering operation of the lifting arms by generating a hydraulic command signal for actuating the spool through the fourth piston.

In an embodiment, the hydraulic arrangement is a closed loop hydraulic circuit.

BRIEF DESCRIPTION OF THE ACCOMPANYING DRAWING

A mechanism for raising and lowering lifting arms of a work vehicle of the present disclosure will now be described with the help of the accompanying drawing, in which.

LIST OF REFERENCE NUMERALS

Figure 1:
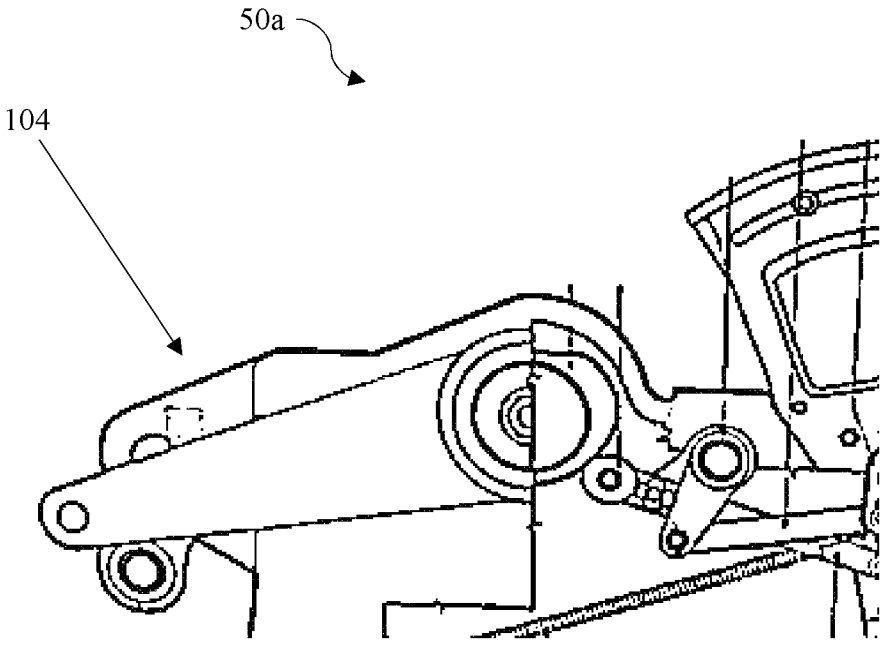
Figure 1 PRIOR ART
FIG. 1 shows a conventional position control mechanism.

50*a*—Conventional position control mechanism
50*b*—Conventional draft control mechanism
100—A mechanism for raising and lowering lifting arms of a work vehicle
102—Steering wheel of work vehicle
103—Column of steering wheel
104—Lifting arm
105*a*—Main cylinder
105*b*—Main piston
105*c*—Main control valve
106—Spool
108—Drive-linkage
111—Operating lever
112—Fluid conduit
110*a*—First cylinder
110*b*—First piston
115*a*—Second cylinder
115*b*—Second piston
120*a*—Third cylinder
120*b*—Third piston
125*a*—Fourth cylinder
125*b*—Fourth piston

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, operations, elements, modules, units and/or components, but do not forbid the presence or addition of one or more other features, operations, elements, components, and/or groups thereof.

When an element is referred to as being "mounted on," "engaged to," "connected to," or "coupled to" another element, it may be directly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Terms such as "inner," "outer," "beneath," "below," "lower," "above," "upper," and the like, may be used in the present disclosure to describe relationships between different elements as depicted from the figures.

Work vehicles such as tractors include a position control means and a draft control means for a ground working implement attached thereto. The term 'tractor' refers all type of agricultural work vehicles. Each of these control means is adapted to be operated in accordance with the type of the ground working implement attached to the tractor. The ground working implements may include land leveler, rice transplanter plough, and power tiller, to name a few.

The position control means maintains the implement at a constant working level in spite of differences in soil conditions, whilst the draft control means gives a constant draft force, permitting the implement to work at a constant depth in the earth even when the earth geometry is irregular in the same type of soil, so as to maintain draft resistance at a constant level despite the irregularities in the soil surface. Thus the draft control means affords a well-controlled draft force to the tractor to enable the working implement to operate without stalling of the engine and free of troubles even in the presence of obstacles such as stones.

Accordingly, the position control means is useful for working implements which operate out of engagement with the earth or which encounter low draft resistance, such as cultivators, fertilizer applicators, seeders, potato planters, etc. On the other hand, the draft control means is advantageous to ploughs or other agricultural implements which require a high draft force.

Figure 2:
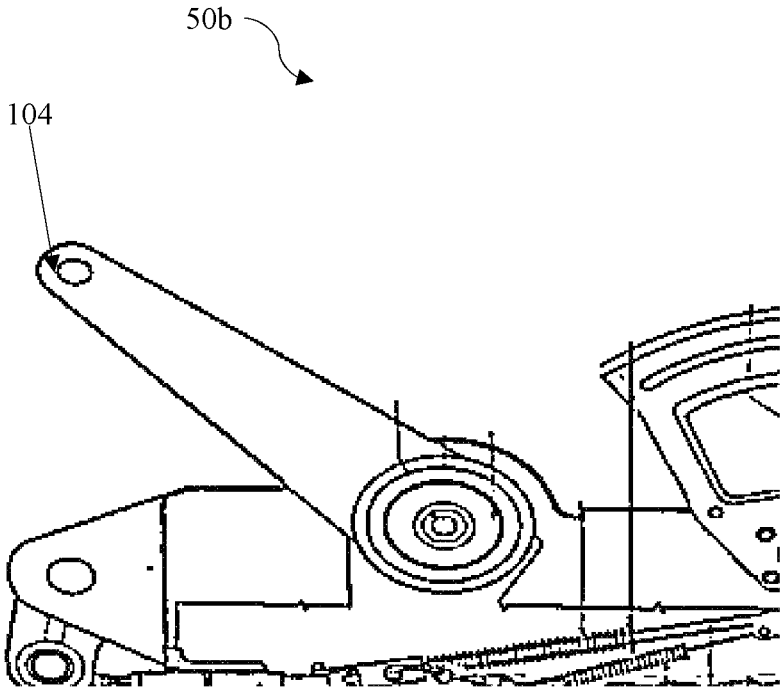
Figure 2 PRIOR ART
FIG. 2 shows a conventional draft control mechanism.

A conventional position control mechanism 50*a* used for position control of a hydraulic system of a work vehicle/tractor is shown in FIG. 1, while FIG. 2 shows a conventional draft control mechanism 50*b* used for a work vehicle/tractor. Both these conventional control mechanism 50*a* and 50*b* comprise a plurality of mechanical components which increases the costs thereof, and for the fitment of these components additional manpower and manufacturing facility is also required. This adds to the overall cost of the product and increases the delivery time.

The arrangement for providing the control levers of the conventional control mechanisms 50*a* and 50*b* is near the driver's seat. The driver finds it difficult to locate the exact position of a particular lever (position control lever or draft control lever) and operating these levers is ergonomically not convenient.

The present disclosure relates to a mechanism for raising and lowering lifting arms 104 of a work vehicle such as a tractor. The system will now be described with the help of FIG. 3 through FIG. 10.

In accordance with the present disclosure, all the mechanical linkages in conventional mechanisms are replaced by hydraulic piping which connects a plurality of piston-cylinders to form a closed loop hydraulic circuit. Thus, hydraulic components perform the function of transmitting motion/forces from one cylinder to another. A single operating lever 111 is positioned at the steering column 103 of the steering wheel 102 for controlling the position and the draft of the work implements. The motive force for raising or lowering the lifting arms 104 is provided by a main piston-cylinder pair 105*a*-105*b*, wherein the main piston-cylinder pair 105*a*, 105*b* is in fluid communication with a high pressure hydraulic fluid/oil source. The operation of the main piston-cylinder pair 105*a*-105*b* is controlled by a main control valve 105*c*. The main control valve 105*c* is actuated by a spool 106 which is configured to reciprocate with respect to the main control valve 105*c*. The main piston 105*b* is mechanically coupled to the lifting arm 104 via a drive-linkage 108.

The mechanism for raising and lowering lifting arms 104 includes a plurality of piston-cylinder pairs which further comprises:

a first cylinder 110*a* with a first piston 110*b* therein;

a second cylinder 115*a* with a second piston 115*b* therein;

a third cylinder 120*a* with a third piston 120*b* therein; and a fourth cylinder 125*a* with a fourth piston 125*b* therein.

The first piston 110*b* is in contact with the spool 106 and is configured for actuating the spool 106. The second piston 115*b* is mechanically connected to the lifting arms 104 and is configured to move in accordance with the movement of the lifting arms 104. The third piston 120*b* is connected to farming/tilling equipment, while the fourth piston 125*b* is installed at the steering column 103 of the work vehicle/tractor.

In an embodiment, all cylinders 110*a*, 115*a*, 120*a*, 125*a* are connected to one another via fluid conduits 112 while the operating lever 111 is mechanically coupled to the fourth piston 125*b* for controlling the raising and lowering operation of the lifting arm 104 by generating hydraulic command signals for actuating the spool 106 by means of the fourth piston-cylinder pair 125*a*, 125*b*.

The second piston-cylinder pair 115*a*-115*b* is configured for sensing the position of the lifting arm while the third piston-cylinder pair 120*a*-120*b* is configured for sensing the draft force of the ground working implement. The fourth piston-cylinder pair 125*a*-125*b* is provided near the steering wheel 102 for triggering/effecting the position control operation.

The first cylinder 110*a* is in fluid communication with the third cylinder 120*a* via a fluid conduit 112, while the second cylinder 115*a* is fluidly connected to the fourth cylinder 125*a* via another fluid conduit 112. All these cylinders 110*a*, 115*a*, 120*a*, 125*a* are connected through fluid conduits to form a closed loop circuit. The pistons 110*b*, 115*b*, 120*b*, 125*b* get actuated for different control operations as per requirement and hydraulic signal received from the operating lever 111. The second piston 115*b* moves in proportion to the movement of the lifting arms 104.

All the cylinders 110*a*, 115*a*, 120*a*, 125*a* get actuated and carry out the function of the respective conventional mechanical linkages as per Pascal law. In an embodiment, all these four cylinders 110*a*, 115*a*, 120*a*, 125*a* are connected to a single port.

The size of the fourth cylinder 125*a* depends upon the stroke of the first cylinder 110*a*. The size of the first cylinder 110*a* depends upon the stroke of the spool 106 and as per the functional requirements of the main control valve 105*c*.

The size and the stroke of the third cylinder 120*a* further depend upon the operational length of the spool 106 which will be different for different manufacturer. The size and the stroke of the main piston-cylinder pair 105*a*-105*b* depend upon its position with respect to the lifting arms 11, the relative location of the pivot point of the main cylinder 105*a*. If the pivot point is located near the center of the main cylinder 105*a*, the stroke required will be less and when the pivot point is away from the center, the stroke will be more.

Diameters/size of these cylinders will be depending upon the stroke requirements. As this is a closed loop circuit, the size calculation will be based on Pascal law.

Figure 3:
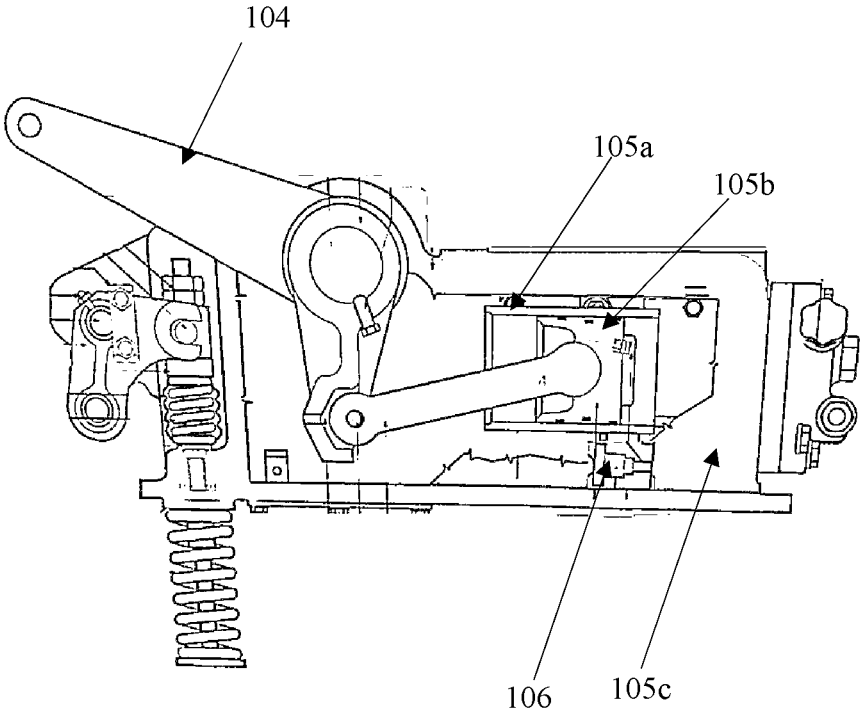
FIG. 3 shows the standard components of a hydraulic system of a work vehicle.

FIG. 3 shows the standard components of a hydraulic system of a work vehicle/tractor.

Figure 4:
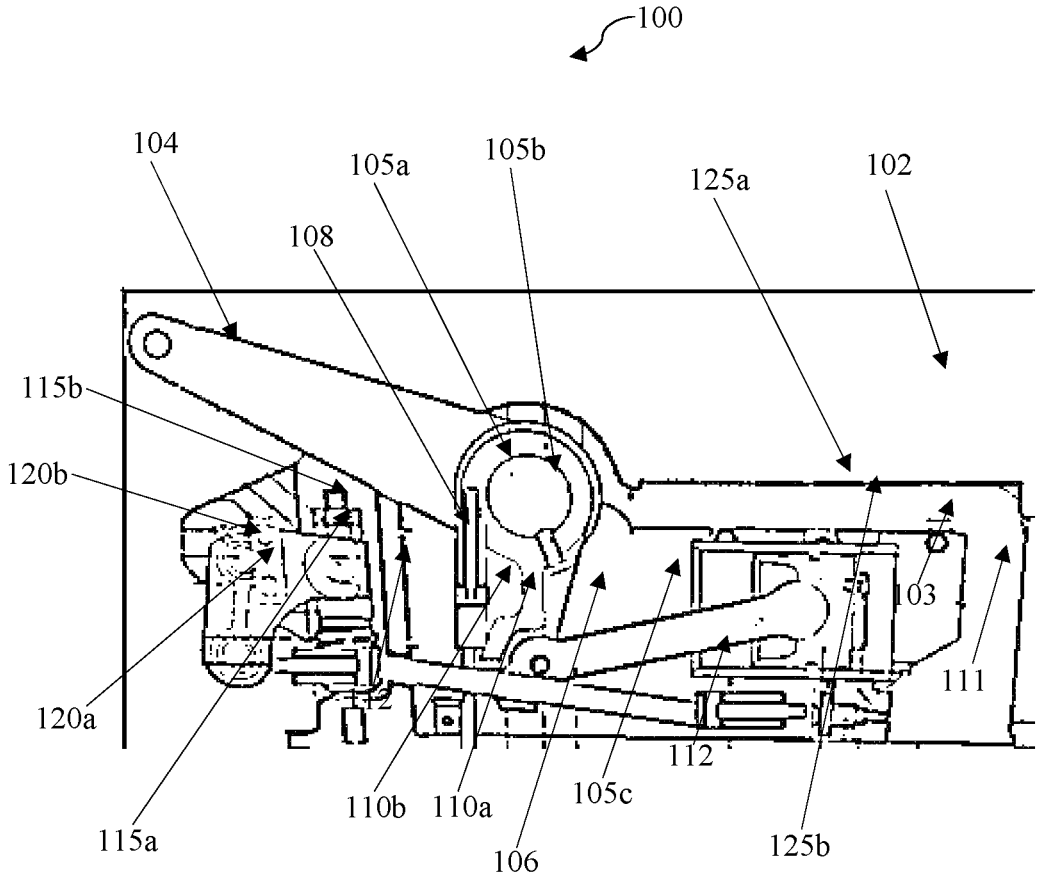
FIG. 4 shows a schematic view of a mechanism for raising and lowering lifting arms of a work vehicle.

FIG. 4 shows a schematic view of a mechanism for operating the lifting arms 104 of a work vehicle (e.g., tractor) along with the cylinders 110*a*, 115*a*, 120*a*, 125*a* in their respective positions inside a hydraulic housing.

Figure 5:
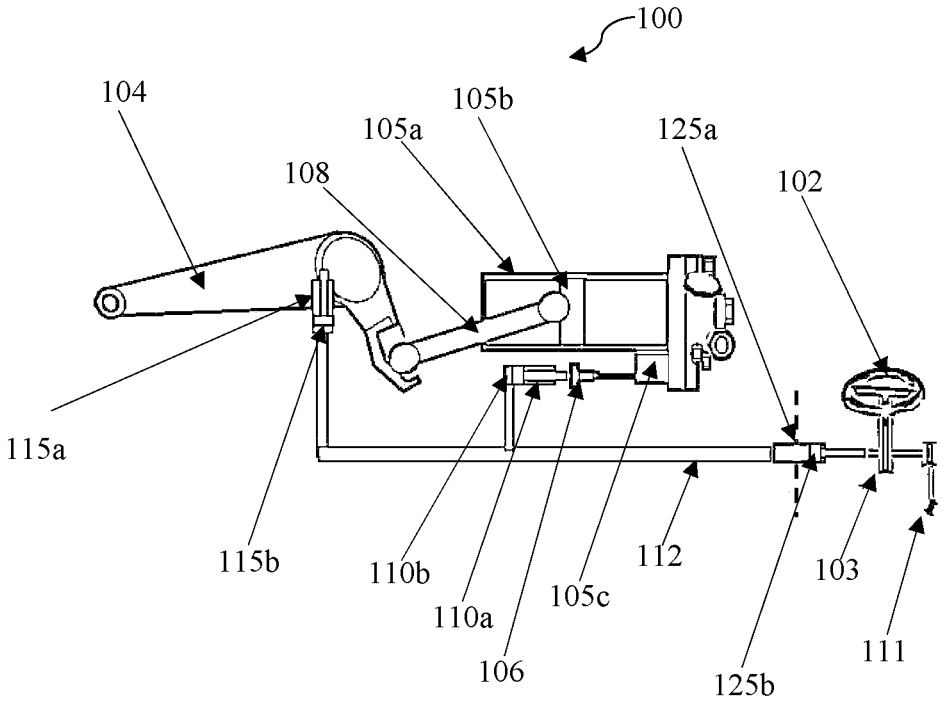
FIG. 5 shows a schematic view of the mechanism for raising and lowering lifting arms of a work vehicle, with the lifting arms in their lower position.

FIG. 5 shows a schematic view of the system for raising and lowering in accordance with an embodiment of the present disclosure. The lifting arms 104 as seen in the FIG. 5 are at their lowered position, while the fourth piston 125*b* is in a non-actuated state.

Figure 6:
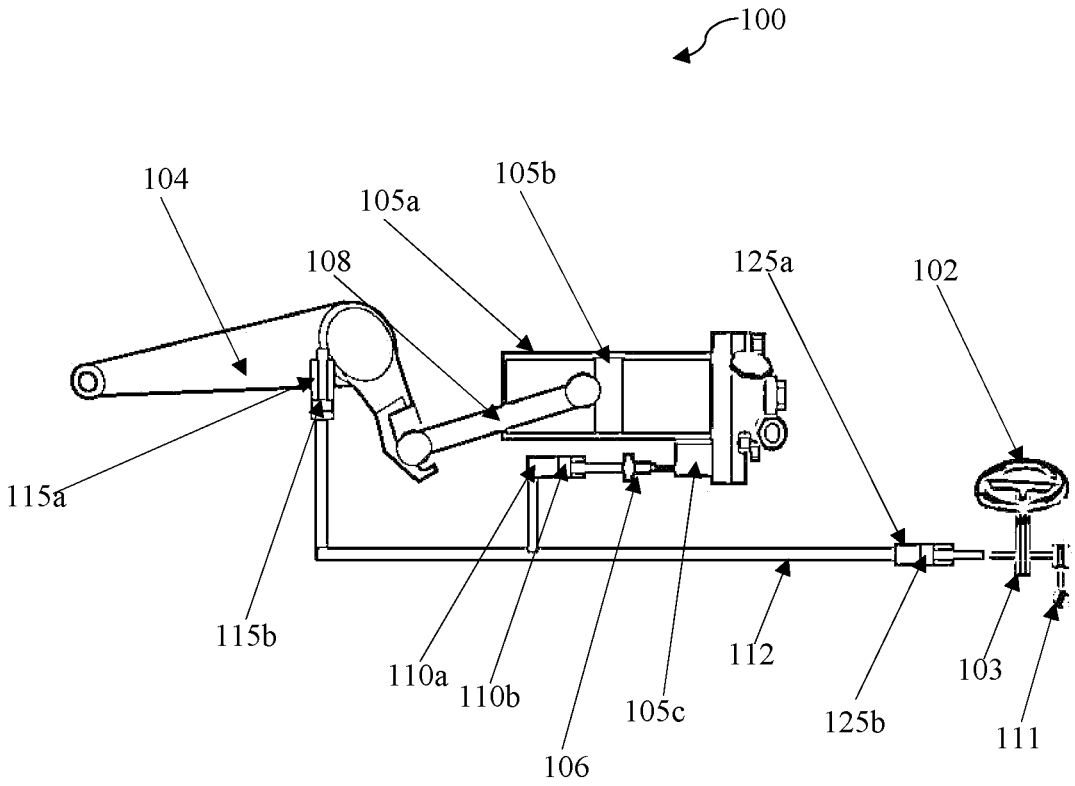
FIGS. 6 and 7 show schematic views of the mechanism for raising and lowering lifting arms of a work vehicle, and the operation of an operating lever for raising the lifting arms to a central position.

FIG. 6 shows a schematic view of the system of FIG. 5, wherein the operating lever 111 is operated for effecting the movement of the lifting arms 104 towards a central position. The operating lever 111 displaces the fourth piston 125*b* up to a position marked by a dotted line in the FIGS. 5 and 6. The movement of the fourth piston 125*b* pushes the first piston 110*b* which further pushes the spool 106. The spool 106 actuates the main control valve 105*c* to allow the pressurized hydraulic fluid to enter the main cylinder 105*a*. The pressurized fluid pushes the main piston 105*b* towards its extended position which further displaces the lifting arms 104 up to a central position thereof. The movement of the lifting arm 104 pulls the third piston 120*b* which creates an extra space for fluid in the third cylinder 120*a*. As a result, fluid from the first cylinder 110*a* flows into this space and thus the first piston 110*b* returns to its initial neutral position. The spool 106 being spring loaded moves towards the first piston 110*b*. A compression spring is provided between the spool 106 and the main control valve 105*c*.

Figure 7:
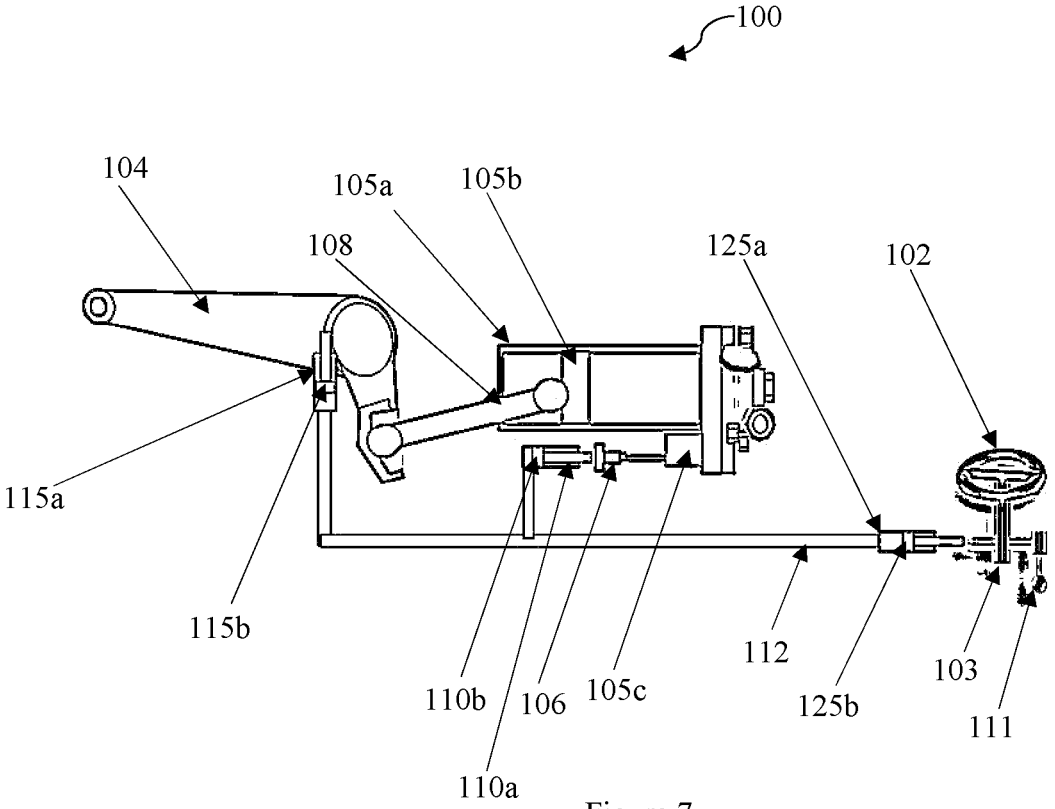

FIG. 7 shows a schematic view of the mechanism 100 of the work vehicle wherein the lifting arms 104 are in their central position, while the first piston 110*b* and the fourth piston 125*b* take their initial positions.

Figure 8:
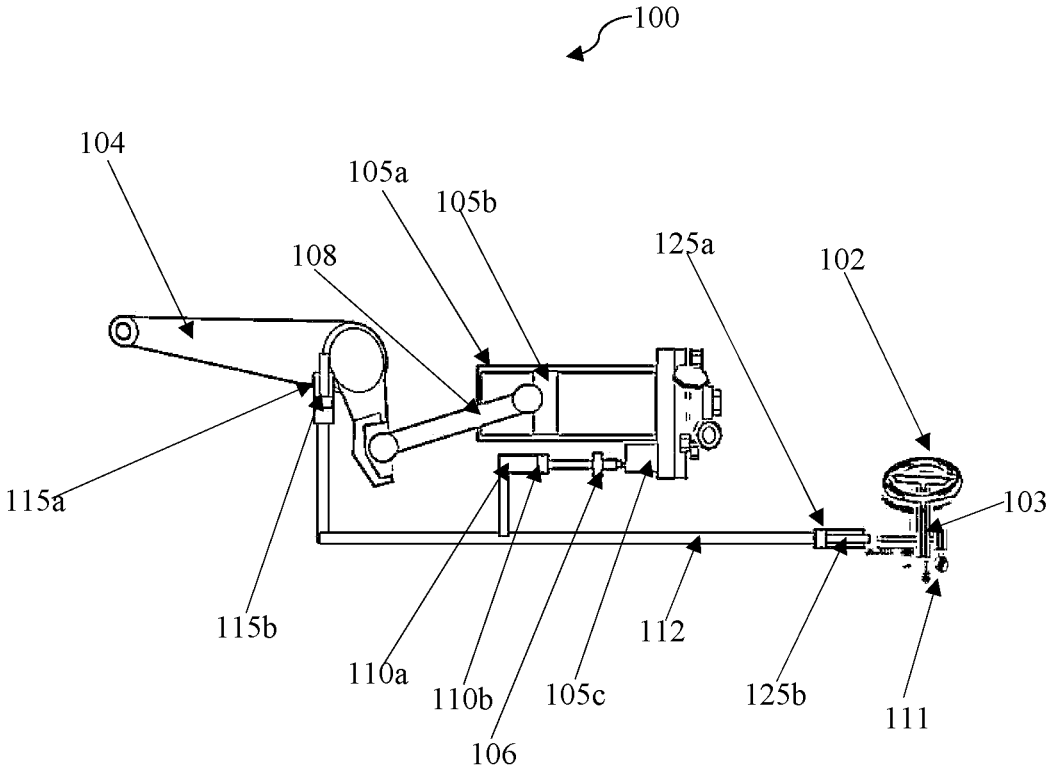
FIG. 8 shows a schematic view of the mechanism for raising and lowering lifting arms of a work vehicle, with the lifting arms in their central position.
Figure 9:
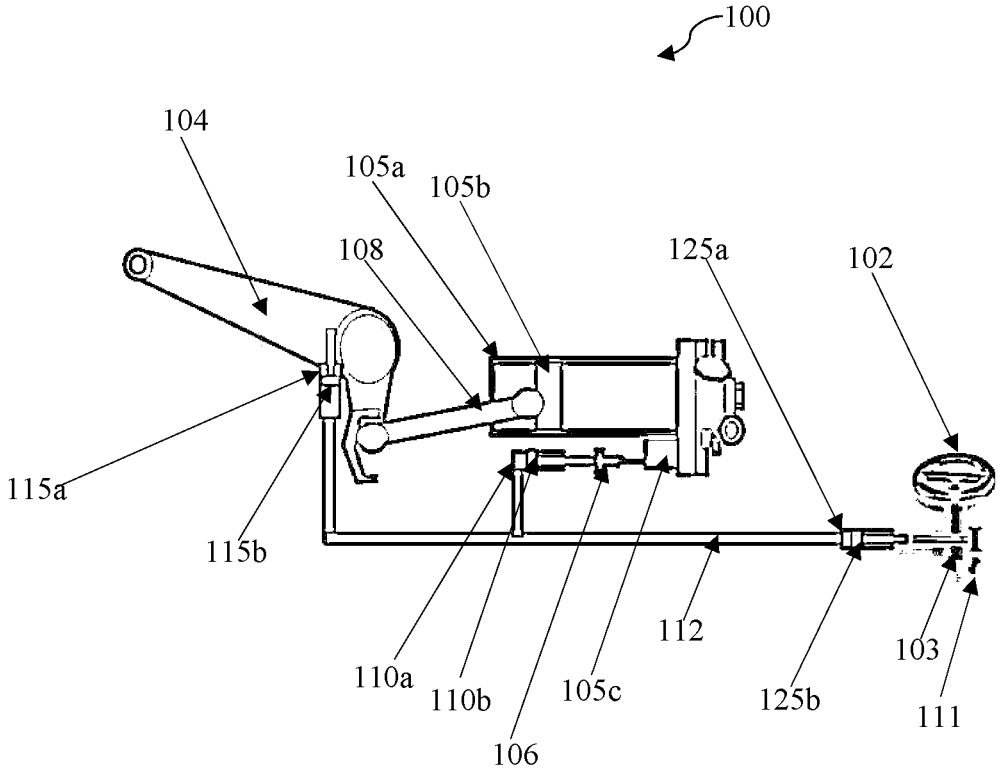
FIG. 9 shows a schematic view of the mechanism for raising and lowering lifting arms of a work vehicle, and the operation of the operating lever for raising the lifting arms to a top position.
Figure 10:
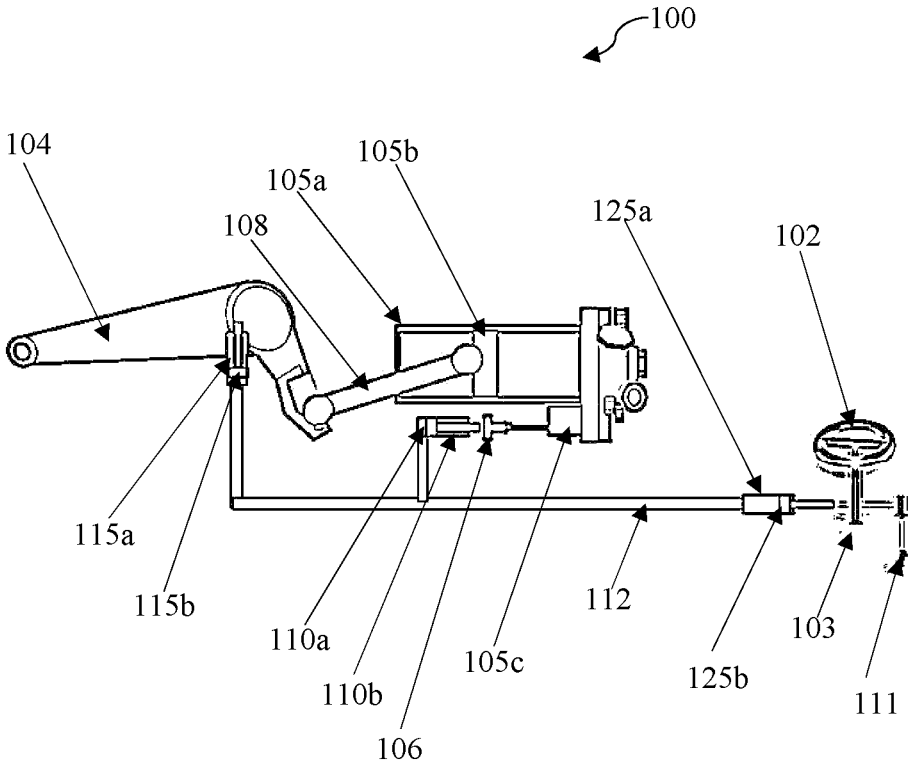
FIG. 10 shows a schematic view of the mechanism for raising and lowering lifting arms of a work vehicle wherein the lifting arms are in their lower position.

FIG. 8 shows a schematic view of the mechanism 100 of the work vehicle at the instant when the driver has operated the operating lever 111 to initiate the raising operation of the lifting arms 104 to their top position. The fourth piston 125*b* has completely moved into the fourth cylinder 125*a*. The fluid displaced by the fourth piston 125*b* pushes the first piston 110*b* towards its maximum extended position which further pushes the spool 106 completely inside the main control valve 105*c*. As a result, more pressurized fluid enters the main cylinder 105*a* and the main piston 105*b* forces the lifting arms 104 towards and up to their top position. The movement of the lifting arms 104 to their top position further pulls the third piston 120*b*, thereby creating more space in the cylinder head region of the third cylinder 120*a*. As a result, fluid from the first cylinder 110*a* flows into this space and thus the first piston 110*b* again returns to its initial neutral position as seen FIG. 9.

For lowering the lifting arms 104 the driver actuates the operating lever 111 in a reverses manner such that the fourth piston 125*b* is in a completely extended position. The same can be seen in FIG. 10. As a result, the first piston 110*b* is moved towards the head of the first cylinder 110*a* and thus the spool 106 is retracted from the main control valve 105*c*. The retraction of the spool 106 results in an outflow of the pressurized fluid from the inside of the main cylinder 105*a*. The main piston 105*b* moves towards the head (Top Dead Center) of the main cylinder 105*a* which causes the lowering of the lifting arms 104.

In an embodiment, the plurality of linkages is electro-mechanical wherein the electro-mechanical linkages are powered by a battery pack. The spool 106 can also be electrically actuated.

In accordance with an embodiment of the present disclosure, the movement of the operating lever 111 can be controlled by a micro-controller and an electrical actuating means.

By eliminating several steps in the assembly process of the mechanical linkages of the conventional hydraulic systems, a considerable cost reduction involved in manufacturing is achieved.

With the use of the system of the present disclosure the area available beside the driver's seat is free of levers and there is no safety hazard as such. This area above the rear mud guard/cover can now be made available for another operator to have a seat on the tractor along with the driver. The play area that is available for the driver is also increased when compared with a tractor fitted with the conventional mechanical linkages.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described herein above has several technical advantages including, but not limited to, the realization of a system for raising and lowering lifting arms of a work vehicle, which:

- is easy to operate;
- is ergonomically convenient to operate;
- reduces the manufacturing cost;
- eliminates numeral steps in the assembly process of mechanical linkages that are used in conventional systems; and
- provides a seating area for a second person besides the driver of the tractor.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A mechanism (100) for raising and lowering lifting arms (104) of a work vehicle, said mechanism (100) comprising:

- an operating lever (111) secured at the column (103) of the steering wheel (102) of the vehicle;
- a hydraulic arrangement and at least one linkage, provided between said operating lever (111) and said lifting arms (104) of said work vehicle, said hydraulic arrangement comprising a plurality of piston-cylinder pairs provided between said at least one linkage and said operating lever (111), each of said plurality of piston-cylinder pairs comprising:
  - a main cylinder (105*a*) and a main piston (105*b*) reciprocating therein, said main piston (105*b*) configured to provide a motive force for raising and lowering of said lifting arms (104) via a drive-linkage (108);
  - a main control valve (105*c*) with a spool (106) thereon, configured for controlling the flow of pressurized fluid into and out of said main cylinder (105*a*);

a first cylinder (110*a*) and a first piston (110*b*) reciprocating therein, said first piston (110*b*) being in contact with said spool (106) and configured to actuate said spool (106);

a second cylinder (115*a*) and a second piston (115*b*) reciprocating therein, said second piston (115*b*) being mechanically connected to said lifting arms (104) and configured to move in accordance with the movement of said lifting arms (104);

a third cylinder (120*a*) and a third piston (120*b*) reciprocating therein, said third piston (120*b*) being connected to a farming/tilling equipment; and a fourth cylinder (125*a*) and a fourth piston (125*b*) reciprocating therein, said fourth piston (125*b*) being located on the steering column of the work vehicle, wherein, in an operative configuration of said mechanism, said cylinders (110*a*, 115*a*, 120*a*, and 125*a*) are connected to one another via fluid conduits (112) and said operating lever (111) is mechanically coupled to said fourth piston (125*b*), wherein actuation of said operating lever (111) generates a hydraulic command signal for actuating said spool (106) through said fourth piston (125*b*), to facilitate raising and lowering of said lifting arms (104).

2. The mechanism (100) for raising and lowering lifting arms (104) of a work vehicle as claimed in claim 1, wherein said mechanism (100) includes a plurality of linkages provided between said operating lever (111) and said lifting arms (104) of said work vehicle.

3. The mechanism (100) for raising and lowering lifting arms (104) of a work vehicle as claimed in claim 1, wherein a compression spring is provided between said spool (106) and said main control valve (105*c*), said compression spring configured to maintain said spool (106) in a retracted position with respect to said main control valve (105*c*) in an inoperative configuration thereof.

4. The mechanism (100) for raising and lowering lifting arms (104) of a work vehicle as claimed in claim 1, wherein said hydraulic arrangement is a closed loop hydraulic circuit.

* * * * *